US007731190B2

(12) United States Patent
Taig et al.

(10) Patent No.: US 7,731,190 B2
(45) Date of Patent: Jun. 8, 2010

(54) GRIPPER CONTROL SYSTEM USING A SERVO DRIVEN CAM AND A METHOD FOR USE THEREOF

(75) Inventors: Elad Taig, Ramat Gan (IL); Haggai Abbo, Kyriat Ono (IL); Gilad Tzori, Moshav Satariyya (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 434 days.

(21) Appl. No.: 11/543,577

(22) Filed: Oct. 5, 2006

(65) Prior Publication Data

US 2008/0084023 A1 Apr. 10, 2008

(51) Int. Cl.
*B65H 5/02* (2006.01)

(52) U.S. Cl. ..... 271/277; 271/82

(58) Field of Classification Search ..... 271/277, 271/275, 82

See application file for complete search history.

(56) References Cited

U.S. PATENT DOCUMENTS 5,335,597 A * 8/1994 Helmstadter ..... 101/485
5,390,601 A * 2/1995 Fricke et al. ..... 101/409
6,437,333 B1 * 8/2002 Suhara et al. ..... 250/341.1
6,877,430 B2 4/2005 Muller
2005/0167246 A1 * 8/2005 Caunter ..... 198/644

FOREIGN PATENT DOCUMENTS

DE 4200406 7/1993

* cited by examiner

*Primary Examiner*—Patrick Mackey
*Assistant Examiner*—Michael C McCullough

(57) ABSTRACT

A gripper system for controlling the loading and unloading of sheets on a cylindrical sheet guide. The gripper system comprises one or more grippers, which are positioned at an outer edge of the cylindrical sheet guide. Each gripper is coupled to a cam follower. The gripper system further comprises a cam, which is configured for affecting the elevation of the gripper(s) by moving the cam follower(s), and a servomotor, which is adapted for steering the cam. A cam-gripper controller is provided for controlling the servomotor according to a current printing profile.

13 Claims, 11 Drawing Sheets

GRIPPER CONTROL SYSTEM USING A SERVO DRIVEN CAM AND A METHOD FOR USE THEREOF

FIELD AND BACKGROUND OF THE INVENTION

The present invention relates to a gripper system and method for a cylindrical sheet guide and, more particularly but not exclusively, to a sheet-fed rotary printing press, as well as to a sheet-processing machine having a gripper system and a method for use thereof.

In most printing presses, sheet-fed rotary printing mechanisms are used. Each sheet-fed rotary printing mechanism integrates one or more cylindrical sheet guides in order to process the sheets and pass them among the different assemblies of a printing press. For example, most high-speed, sheet-fed rotary printing presses are provided with an impression drum, which is used for printing. Cylinders which permit the press to print on two sides of a sheet, and which can also be used for single-sided, multi-color printing are also commonly used.

In order to retain sheets on cylindrical sheet guides and in order to allow the transferring of sheets to and from the cylindrical sheet guides, grippers are usually used. The grippers are needed in order to facilitate the loading and unloading of sheets to and from the cylindrical sheet guides. Transmission elements and adjusting mechanisms are usually needed in addition to the grippers in order to coordinate among the printing press assemblies during the loading and unloading of the sheets and in order to allow different movement patterns of the sheets within the printing press. A turning impression drum, for example, is usually designed with spaces to receive grippers and transmission elements and has a cylindrical sheet support surface operative to guide the sheets, which extends over more than half the surface of the turning impression drum. Assembly and maintenance of these systems are, therefore, often fairly complex.

German Patent No. 4200406, published on Jul. 15, 1993, discloses a gripping device that integrates sensors. The device includes grippers for a sheet-like material which are fastened to a gripper-operating shaft. The grippers are simultaneously opened and closed via a cam control device. Individual grippers or groups of grippers on the edge of a cylindrical sheet guide may be activated independently of one another by a control device. The control device includes at least one sensor, an opening and closing mechanism for the grippers and a computer. The sensors are angle-of-rotation sensors or sheet-position sensors, which detect either the position of the cylinder or the position of the sheet-like material, in order to actuate the opening and closing mechanism.

The device has a mechanical cam mechanism. Such mechanisms are disadvantageous in that, usually, a fixed mechanical coupling is provided for the main machine drive and, due to its dimensioning, it is not possible to change the movement thereof. Therefore, movement of the machine drive cannot readily be adapted during operation to changing boundary conditions, e.g., a change in the thickness of printing-materials. Moreover, since the system is subjected to disruptive forces during the gripper actuation, this causes the machine to be subjected to a retroactive torque effect.

In order to avoid the aforementioned disadvantages and because the movement patterns are so complex, the grippers must be carefully designed and controlled. Since, today, mechanical processes are computerized and are hardware and software based, it is preferable that control of the grippers be done by integrating such hardware- and software-based processes into gripper control mechanisms.

For example, U.S. Pat. No. 6,877,430, issued on Apr. 12, 2005, discloses a gripping device for a sheet processing machine that comprises grippers that may be adjusted during the printing process. The gripping device includes a gripper, a gripper pad associated with the gripper and a first drive for moving the gripper from an open position to a closed position. The gripper is engageable with the gripper pad for producing a clamping force for holding sheets being processed. A second drive is operable independent of the first drive, during a printing operation of the sheet-processing machine. The first and second drives position the gripper and the gripper pad so that clamping faces of one are moved so that they are perpendicular to clamping faces of the other.

In one embodiment, the second drive comprises a piezoelectric sensor that measures a compressive force in order to calculate the desired position values for the gripper pad. These values are fed to the power electronics in order to move the second drive into the appropriate position until the actual value of the clamping force, which is determined via the force sensor, corresponds to the desired value for the clamping force determined by the control device.

Since the gripper pads of the device are not vertically adjustable, the device does not have to be adapted for different sheet thicknesses so as to avoid deformations of the sheet in the region of the grippers. The device thus overcomes some of the disadvantages of other such devices. However, there is no means for allowing the printing press to optimally adjust the opening and closing of the grippers, depending on the sheet properties, during the printing process. There is thus a widely recognized need for, and it would be highly advantageous to have, a gripper system devoid of the above limitations.

SUMMARY OF THE INVENTION

According to one aspect of the present invention there is provided a gripper system for controlling the loading and unloading of sheets on a cylindrical sheet guide. The gripper system comprises grippers which are positioned at an outer edge of the cylindrical sheet guide. The grippers are coupled to cam followers. The gripper system further comprises a cam which is configured for affecting the elevation of the grippers by moving the cam followers, a servomotor which is adapted for steering the cam and a cam-gripper controller which is adapted for controlling the servomotor according to a current printing profile.

In one embodiment the cam is one member of the group consisting of: a rotary cam and a linear cam.

In one embodiment the gripper system further comprises a first feedback unit for indicating the current rotational angle of the cylindrical sheet guide and a second feedback unit for indicating the current rotational angle of an axle of the servomotor, the cam-gripper controller being adapted for controlling the servomotor in response to signals transmitted thereto from the first and second feedback units.

In another embodiment each of the first and second feedback units comprises members of the group consisting of: an encoder, a resolver and a tachometer.

In one embodiment the cam-gripper controller is adapted to change the velocity and/or the direction of an axle of the servomotor.

In one embodiment the cam-gripper controller is coupled to a printing profile repository, the printing profile repository comprising a number of predefined printing profiles.

In another embodiment the gripper system further comprises a man machine interface (MMI) for enabling a user to have the ability to choose a current printing profile from the number of predefined printing profiles.

In another embodiment the gripper system further comprises a sheet thickness identifier, the sheet thickness identifier being adapted for choosing a current printing profile from the number of predefined printing profiles.

In another embodiment the sheet thickness identifier comprises an image sensor and an image-processing unit.

In another embodiment the mechanical profile of the cam is configured relative to the number of predefined printing profiles.

In another embodiment the number of predefined printing profiles is configured according to a number of printing-material thicknesses.

In one embodiment the cam, the servomotor, and the cam-gripper controller are positioned within the cylindrical sheet guide.

The cylindrical sheet guide may be one of the following group: an impression drum, a storage drum, a delivery drum and a perfecting cylinder.

In one embodiment each of the at least one cam follower is coupled to the cam by a movable mechanical bridge.

The servomotor may be a servo-pneumatic actuator.

According to another aspect of the present invention there is provided a method for controlling loading and unloading of sheets from a cylindrical sheet guide. The method comprises the following steps: a) providing a gripper system operable for controlling the elevation of at least one gripper on the cylindrical sheet guide, the gripper system being associated with a servomotor, b) receiving a predefined elevation profile representing the elevation of the at least one gripper during at least one revolution of the cylindrical sheet guide, and c) using the servomotor according to the predefined elevation profile to facilitate loading and unloading of sheets from the cylindrical sheet guide by actuating the gripper system.

In one embodiment the method further comprises a step (a1) between step (a) and step (b) of identifying the current rotational position of the cylindrical sheet guide and of an axle of the servomotor.

The method may further comprise a step (a2) between step (a1) and step (b) of synchronizing the rotational position of the guiding sheet cylinder with the rotational position of the axle of the servomotor.

In another embodiment the synchronizing is done by comparing a feedback signal from the servomotor and a reference pattern that represents a known initial rotational position of the axle of the servomotor with a known rotational position of the cylindrical sheet guide.

The predefined elevation profile of step (b) may be received from an elevation profile repository, wherein the predefined elevation profile is chosen by a user.

In one embodiment the predefined elevation profile of step (b) is received from an elevation profile repository, wherein the predefined elevation profile is chosen according to a control signal received from a sheet thickness identifier.

Unless otherwise defined, all technical and scientific terms used herein have the same meaning as commonly understood by one of ordinary skill in the art to which this invention belongs. The materials, methods, and examples provided herein are illustrative only and are not intended to be limiting.

Implementation of the method and system of the present invention involves performing or completing certain selected tasks or steps manually, automatically, or a combination thereof. Moreover, according to actual instrumentation and equipment of some embodiments of the method and system of the present invention, several selected steps could be implemented by hardware or by software on any operating system of any firmware or a combination thereof. For example, as hardware, selected steps of the invention could be implemented as a chip or a circuit. As software, selected steps of the invention could be implemented as a number of software instructions being executed by a computer using any suitable operating system. In any case, selected steps of the method and system of the invention could be described as being performed by a data processor, such as a computing platform for executing a number of instructions.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the embodiments of the present invention only, and are presented in order to provide what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings.

DESCRIPTION OF THE EMBODIMENTS

Figure 1:
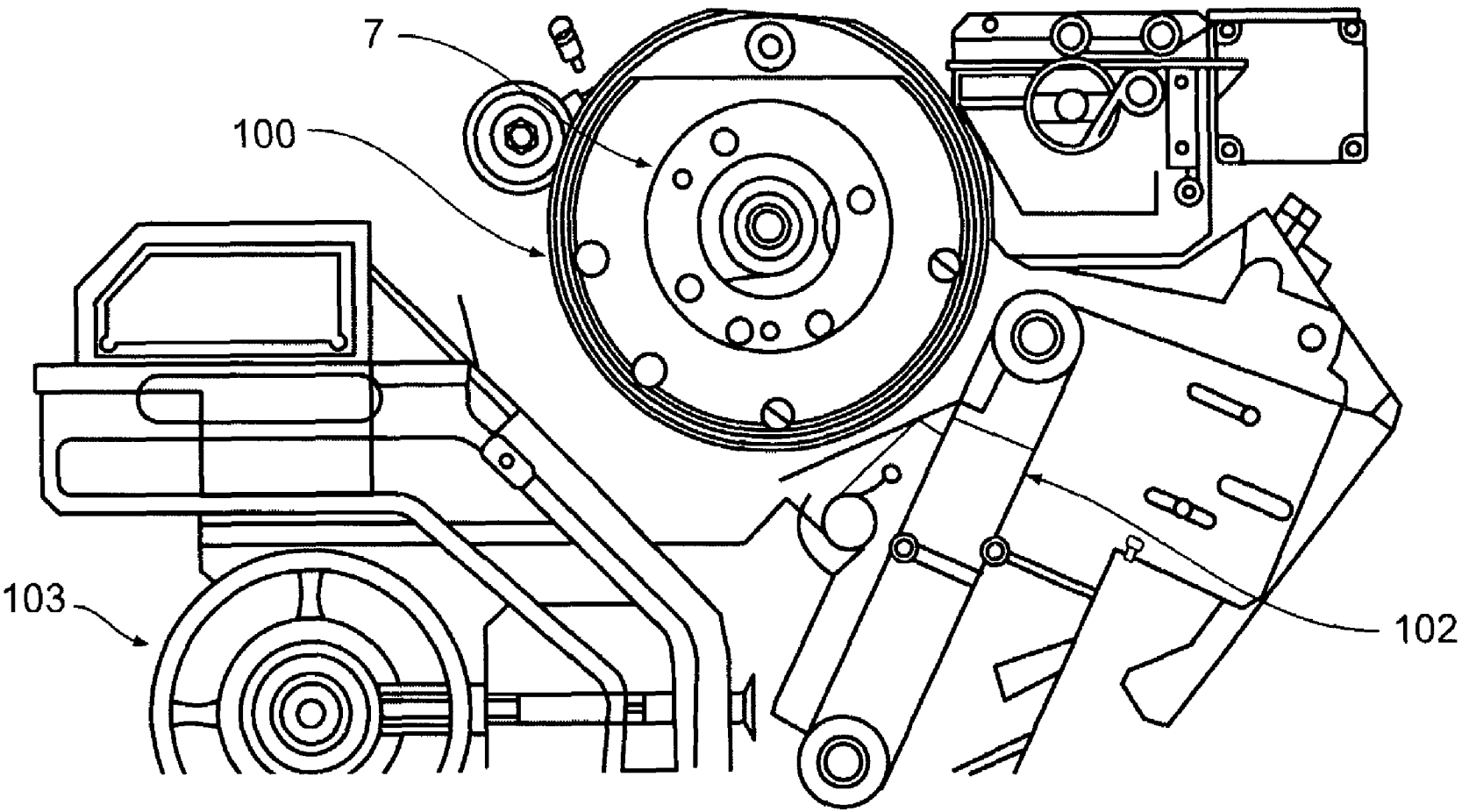
FIG. 1 is a schematic sectional view of a printing press including an exemplary impression drum and gripper system, according to one embodiment of the present invention.

The present embodiments comprise a system and a method for gripper control, using a servo-driven cam. The principles and operation of a system and method according to the present invention may be better understood with reference to the drawings and accompanying description.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

In one embodiment of the present invention, a gripper system for controlling the loading and unloading of sheets on a cylindrical sheet guide is disclosed. The gripper system comprises one or more grippers mounted on one axis, which is positioned at the outer edge of a cylindrical sheet guide. The gripper axis is coupled to a cam follower. The motion of the cam followers controls the elevation of the grippers. Accordingly, in order to elevate or lower the gripper axis, a cam is pivoted in the vicinity of the cam followers. A servomotor having an axle is adapted for steering the cam. A cam-gripper controller is configured for controlling the servomotor according to a certain printing profile and actual reading from the press main encoder. The printing profile may be chosen from a printing profile repository that comprises a number of printing profiles, each adapted for a printing-material with different boundary conditions, e.g., different thicknesses.

In another embodiment of the present invention a method for controlling loading and unloading of sheets from a cylindrical sheet guide is disclosed. During the first step, a gripper system operable for controlling the elevation of the grippers on the cylindrical sheet guide is provided. The gripper system is associated with a servomotor. Subsequently, a predefined elevation profile representing the elevation of the grippers during revolutions of the cylindrical sheet guide is received. The profile determines the elevation of the grippers during rotation of the cylindrical sheet guide. The servomotor actuates the gripper system, according to the predefined profile, for loading and unloading of sheets from the cylindrical sheet guide.

Reference is now made to FIG. 1, which is a sectional view of a printing press comprising a cylindrical sheet guide 7. The cylindrical sheet guide 7 may be an impression drum, which is used for printing on sheets which rotate thereon.

The gripper system is used, inter alia, for retaining sheets on the impression drum 7 and for transferring documents between the impression drum 7 and other assemblies of the printing press. Examples of such printing presses are those currently manufactured by Hewlett-Packard Development Company, L.P., under the designations "HP Indigo press 3050," "HP Indigo press 1050" and "HP Indigo press s2000."

In between each gripper and the impression drum 7 there is a sheet holding space. The width of the space is determined by the proximity of the gripper to the outer surface of the impression drum 7. In use, a sheet is fed towards the impression drum 7, and is held in place by grippers. As the impression drum rotates, an image is printed on the sheet. Other drums such as a storage drum or a perfecting cylinder may be used as well.

In order to ensure proper feeding of the sheet, the opening and closing operation of the grippers has to be synchronized with the rotation of the impression drum 7. For example, the grippers have to be opened for allowing loading of a sheet, as shown at 103, from a sheet loader onto the impression drum, and for allowing unloading of a sheet, as shown at 100, into a designated output tray or other systems. In order to allow processing of the sheets, the grippers have to be closed after loading and before unloading.

More complex opening and closing operations are also possible. For example, in one embodiment of the present invention only a portion of a certain printing job, such as one color of a printing job image, is printed on the gripped sheet during each cycle of the impression drum. In this case, the sheet remains gripped until all of the portions of the image that comprises different colors are printed. Thus, the grippers have to remain closed for a number of rotations of the impression drum, until the entire printing job image has been printed on the sheet.

In another embodiment, the grippers have to be synchronized with a perfector mechanism, which may be provided in a high speed, sheet-fed rotary printing press. A perfector mechanism allows the press to print on both sides of a sheet. The perfector mechanism is adjustably timed with respect to the impression drum such that, after printing on one side, the sheet is removed from the impression drum, turned over and transferred back thereto. The opening and the closing operation of the grippers has to be coordinated with the perfector mechanism. If the print job includes printing on only one side of the sheet (simplex printing), the sheet is released from the grippers and ejected into the output tray after one side of the sheet has been fully printed. If, however, the print job includes printing on two sides of the sheet (duplex printing), the sheet is first released from the grippers into a perfector 103, turned over, and then fed back onto the impression drum through the duplex system 102 for printing on the second side. The opening and the closing of the grippers has to be synchronized with the perfector 103 and duplex 102 such that a sheet may be transferred to the perfector 103 and returned to the impression drum after it has been turned over.

Figure 2A:
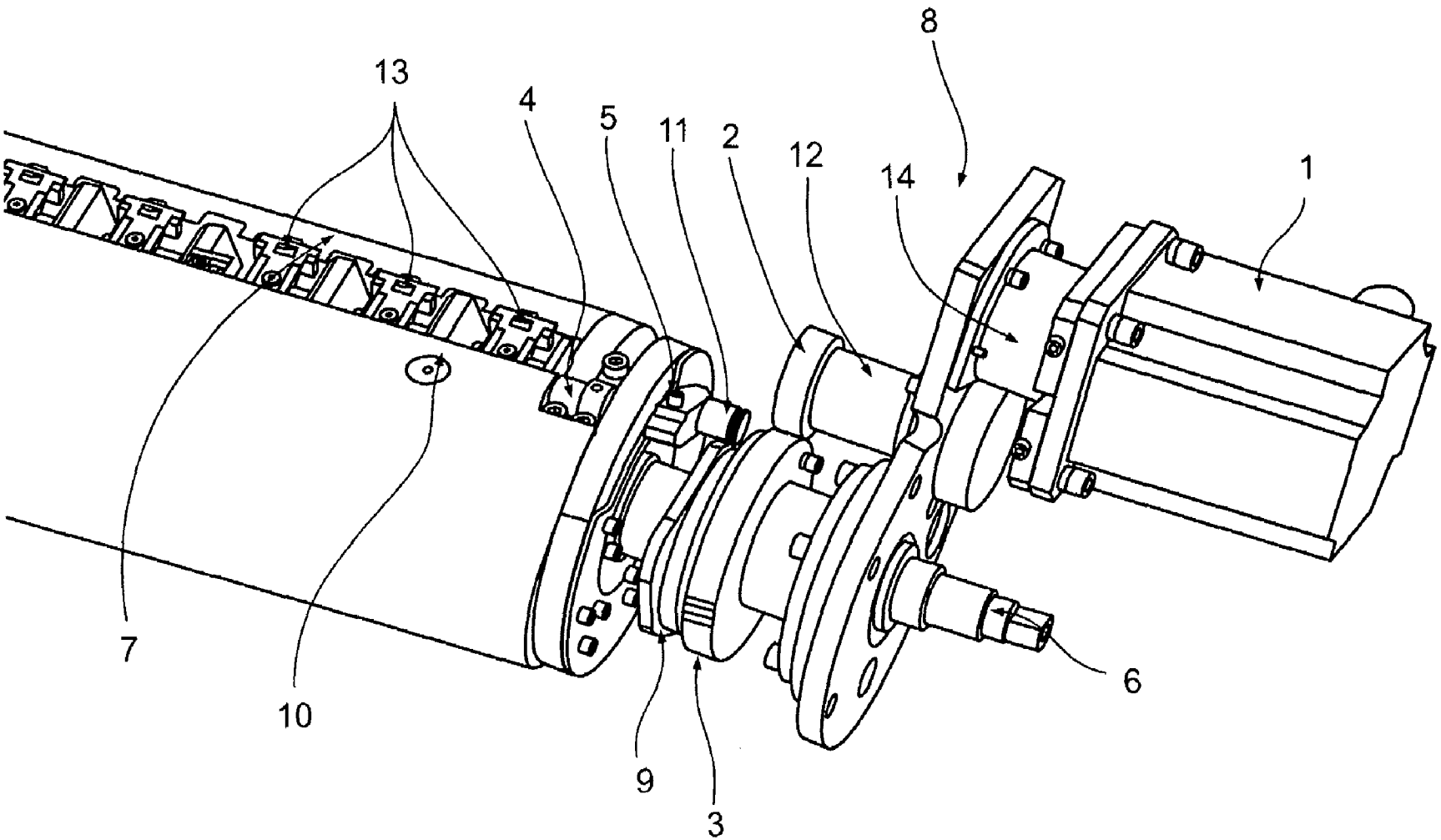
FIG. 2A is a schematic representation of an impression drum having a gripper system with a rotary cam, according to one embodiment of present invention.

Reference is now made to FIG. 2A, which depicts a cylindrical sheet guide 7 and cam gripper system 8. The cam gripper system 8 comprises several parts. One component is a servomotor 1 which is coupled to a stationary printing press and having an axle 14, which is coupled to a gear-wheel 2. The gear-wheel is meshed with an additional gear-wheel 3, such that rotations of the axle 14 results in rotations of the rotary cam 9. The cam gripper system 8 is configured to be detachably coupled with a cam follower 11 which is connected to a gripper axis 4 of a cylindrical sheet guide 7. The gripper axis 4 comprises one or more blades 13 to firmly retain a sheet against the cylindrical sheet guide 7 during the printing process. The rotary cam 9 is pivotally mounted on a shaft, which is coupled to the additional gear-wheel 3, as described below.

The rotary cam 9 has a non-uniformly shaped circumference that represents a profile, which determines the opening and the closing of the gripper axis 4. The cam gripper system 8 is configured to control the cam follower 11. The cam follower 11 maneuvers a gripper axis 4, therewith change the opening height which is formed in between the gripper blades 13 and the cylindrical sheet guide 7. In one embodiment the cylindrical sheet guide 7 is an impression drum. Individual grippers or groups of grippers on the edge of the cylindrical sheet guide are actuated either independently of one another, or simultaneously by the rotary cam 9, as described below.

The cam gripper system 8 may comprise more than one gripper and each gripper is associated with a corresponding cam follower. However, for the sake of simplicity, the description of the present embodiment will include mention of a single gripper 8 and cam follower 11.

The rotational positioning of the rotary cam 9 is controlled by the servomotor 1 as descried below. The cam follower positioning is controlled by the rotational positioning of the rotary cam 9. During the operation of the cylindrical sheet guide 7, the gripper axis 4 is moved by a cam follower 11, for example about a joint axis 5 which is disposed along the rotation axis of the impression drum 7. The rotational movement of the impression drum 7 in relation to the rotation of the rotary cam 9 causing the cam follower 11, to elevate the gripper axis 4 and the gripper blades 13. The rotational angle of the rotary cam 9 relative to the rotational angle of the impression drum 7 determines the points in time at which the gripper is closed and opened, as described below.

A bearing 12 may be positioned at each of the points of contact of the gear-wheel 2 and the servomotor 1, in order to reduce the friction therebetween, so that one may move freely relative to the other. There are numerous bearing mechanisms, which are capable of reducing friction, which are well known in the art and, hence, will not be described here in detail.

Figure 2B:
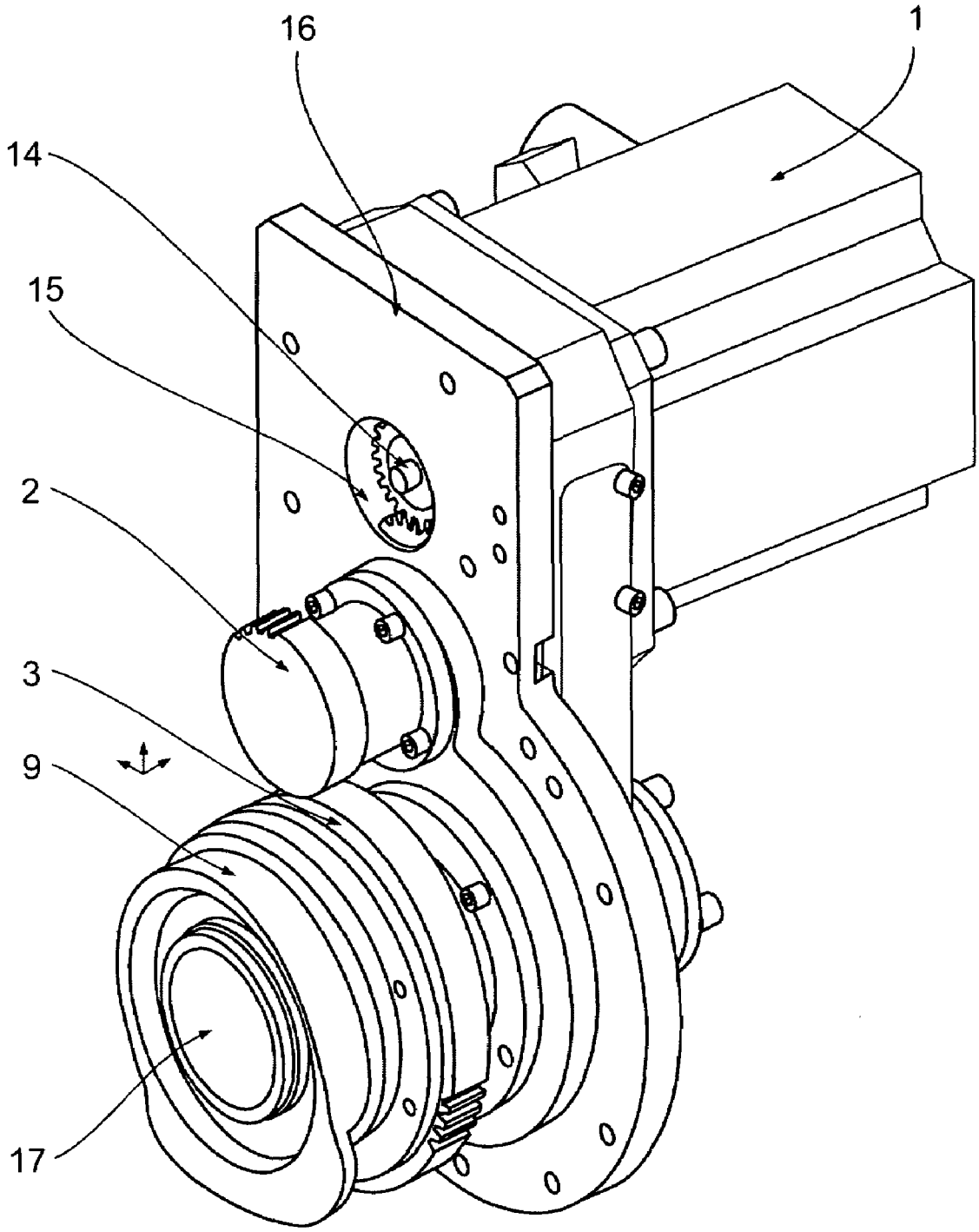
FIG. 2B is a schematic representation of a cam gripper system with a rotary cam, according to one embodiment of present invention.

Reference is now made to FIG. 2B, which depicts another embodiment of the cam gripper system 8. While the servomotor 1, the gear-wheel 2 and the additional gear-wheel 3 are similar to these shown in FIG. 2A above, the cam gripper system 8 is arranged differently. As depicted in FIG. 2B, in one arrangement of the cam gripper system 8 the axle 14 of the servomotor 4 is connected to an additional gear-wheel 15 that actuates the previously described gear-wheels 2, 3. In the depicted arrangement, a wall separates between the impression drum (not shown) and the gear-wheels of the cam gripper system 8. In one embodiment a circular opening 17 is formed in the center of the rotary cam 9 in order to allow the threading of the impression drum axle therethrough.

Reference is now made, once again, to FIG. 2A. In order to allow the proper operation of the printing process, the opening and the closing of the gripper axis 4 has to occur accurately at certain rotational positions of the impression drum 7 and according to specific gripper opening profiles. The accurate rotational position is important, inter alia, in order to facilitate the loading and the unloading of sheets to and from the impression drum 7, as described above.

In order to coordinate opening and the closing of the gripper axis 4 with rotation of the impression drum, the rotational position of the rotary cam 9 and the rotational position of the impression drum 7 have to be coordinated, in order to correlate their rotational positions, the relative rotational angle between them has to be either maintained or changed during the printing process. In operation, the servomotor 1 may alter the rotational position of the rotary cam 9 such that their relative rotational positions are correlated. The servomotor 1 serves as a control device for controlling the rotational position of the rotary cam 9 in the servomechanism. The servomotor is designed to receive command signals, which are issued according to any of a number of printing profiles, from a cam-gripper controller (not shown). In one embodiment the command signals pass via an amplifier that amplifies the command signals to appropriate levels to result in movement of the servomotor axle that rotates gear-wheels 2 and 3 and, thus, the rotary cam 9. An alternating current (AC) may be supplied to the amplifier at a current level, which is adjusted to the required to torque of the servomotor's axle. The servomotor 1 is connected to the cam-gripper controller, which stores information about various printing profiles. In one embodiment the cam-gripper controller has been programmed to control the velocity and direction of rotation of the axle of the servomotor 1. By changing the velocity or direction, the rotational angle of the rotary cam 9 is changed in relation to the rotational angle of the impression drum 7.

Such an embodiment allows the cam-gripper controller to adjust the rotational position of the rotary cam 9 according to a number of different printing profiles, which are adjusted for different types of sheets. Since the rotary cam 9 has a non-uniform profile with projections of various sizes, as described below, one or more grippers 4 may be raised different amounts by the rotation of the rotary cam 9. The rotary cam 9 is designed to allow the positioning of the one or more grippers 13 such that the height which is formed in between the grippers blades 13 and the cylindrical sheet guide may vary accordingly.

Different types of sheets may have different thicknesses. As described above, the grippers are designed to be opened or closed during different stages of the printing process. Grippers are closed for allowing, inter alia, printing on the sheets during the pivoting of the impression drum 7, and are opened in order to enable the transferring of the sheets among different assemblies of the printing press. The height formed in between the gripper blades 13 and the cylindrical sheet guide 7 has to be adjusted for sheets with different thicknesses, since the printing press is used for printing on several types of sheets. The adjustment is important in order to achieve a better grip of each sheet and a smoother transfer of the sheets to and from the impression drum 7. An accurate adjustment of height which is formed in between the grippers blades 13 and the cylindrical sheet guide 7 during the printing process substantially reduces the probability of a sheet jam since the adjusted gripping improves the accuracy of the alignment of the sheets relative to the impression drum 7 and to the other assemblies of the printing press. Moreover, the adjusted gripping may reduce the velocity of angular change of the grippers during the opening or closing thereof, such that there is less jarring of the grippers 4. It should be noted that, by reducing the probability of a sheet jam, the rotation rate of the impression drum 7 may be accelerated, such that the printing rate may be increased without harming the continuity of the printing process.

The cam-gripper controller may be connected to a memory which is configured for storing a number of printing profiles. Each printing profile contains a series of synchronous activating orders, which are configured to instruct the servomotor to change the height which is formed in between the grippers blades 13 and the cylindrical sheet guide 7 by changing the rotational angle or the velocity of the rotary cam 9 during the printing process. During operation of the printing press, the movement of the cam during the rotation of the cylindrical sheet guide can readily be adapted to a change in boundary conditions, e.g., to different printing-material thicknesses. In one embodiment each printing profile corresponds to a particular thickness of a sheet such that, when each sheet is fed into the printing press, the height which is formed in between the grippers blades 13 and the cylindrical sheet guide 7 is adjusted accordingly, during the printing process.

In one embodiment of the present invention, the cam-gripper controller is connected to a sheet thickness identifier. The sheet thickness identifier is configured to detect the thickness of the sheets. In one embodiment the sheet thickness identifier comprises a sensor and an image-processing unit. In one embodiment the sensor is an image sensor complementary metal oxide semiconductor (CMOS) sensor or a charged coupled device (CCD) sensor. The image sensor is positioned in the printing press in a manner such that it measures the distance between the upper surface and the lower surface of the sheets which are conveyed within the printing press. In one embodiment the image-processing unit is used to process the images which are received from the image sensor to output the thickness of the conveyed sheet. In one embodiment the image processing unit outputs a control signal to a controller that chooses a printing profile which corresponds to the identified dimensions of the sheet. The method of identifying the thickness of a sheet by using image processing is well known in the art and, hence, will not be described here in detail.

In order to adjust the height which is formed in between the gripper blades 13 and the cylindrical sheet guide 7 according to a certain printing profile, the cam-gripper controller has to translate the synchronous activating orders into control signals that cause rotation of the axle of the servomotor 1 and pivoting of the rotary cam 9. The control signals determine the direction and the velocity of rotation of the axle of the servomotor 1. The servomotor 1 changes the rotational angle of the rotary cam 9 relative to the current rotational angle of the impression drum 7 such that one or more grippers 4 are elevated, depending on asynchronous activating order.

While FIG. 2A depicts one embodiment of the present invention, it should be understood that, if desired, in other embodiments of the present invention the exact positioning of the servomotor 1, the rotary cam 9, the cam follower 11, and gear-wheels 2, 3 may differ.

In one embodiment of the present invention the rotary cam 9 and the gripper system are positioned within the cylindrical sheet guide 7. Such an embodiment reduces the probability that a certain sheet may become entangled with parts of the gripper system.

Figure 3:
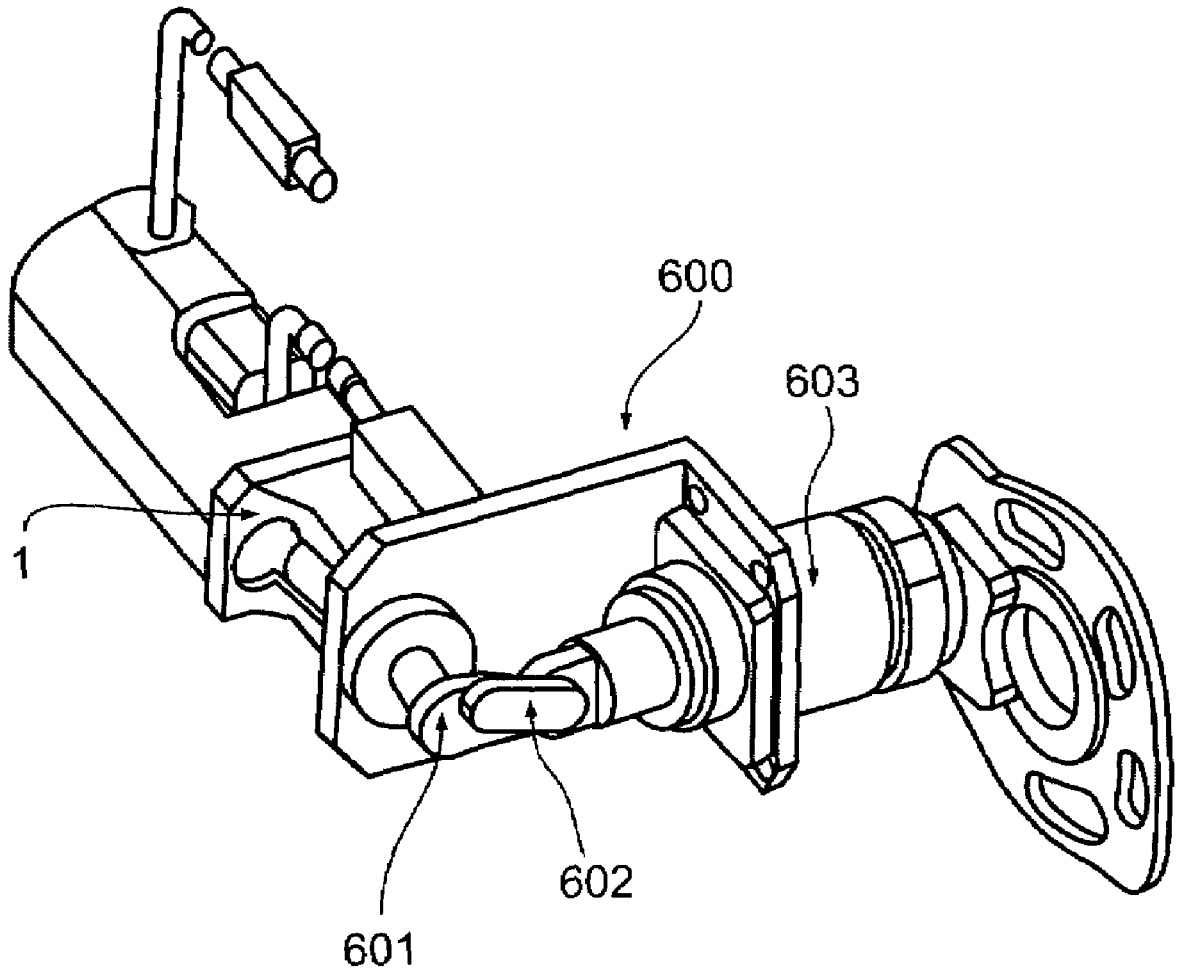
FIG. 3 is a schematic representation of gripper systems with linear cams, according to another embodiment of present invention.

Reference is now made to FIG. 3, which depict another embodiment of the present invention. While the servomotor 1 and the impression drum 7 are similar to those shown in FIG. 2A above, the gripper system comprises several different parts, as will be described below. In the present embodiment, a linear cam 603 is used in order to control the direction and magnitude of the linear motion of the cam follower. Unlike rotary cams, a linear cam moves backwards and forwards. The linear cam 603 has a flat plate cam profile, which engages the cam follower. The shape of the profile determines the degree of elevation of the cam follower. In order to actuate the cam, a linear actuator 600 is used. The axle of the servomotor 1 is connected to a rotary cam 601. The rotary cam 601 is connected firmly to a follower 602, which is firmly connected to the linear cam 603. In use, the linear cam 603 is set in motion and maneuvers the grippers by elevating or depressing a linear cam follower. In one embodiment a servo-pneumatic actuator is used instead of the servomotor 1. The servo-pneumatic actuator receives control signals from the cam-gripper controller in the same manner in which a servomotor receives control signals. However, unlike the servomotor that generates rotational propulsion, the servo-pneumatic actuator generates linear propulsion. Such an embodiment reduces the probability that a certain sheet may become entangled with parts of the gripper system, since the linear cams are usually provided in a closed housing, as shown at 603. It should be noted that the linear motion of the linear cam causes substantially less jarring of the system than does the rotational motion of the rotary cam.

Figure 4:
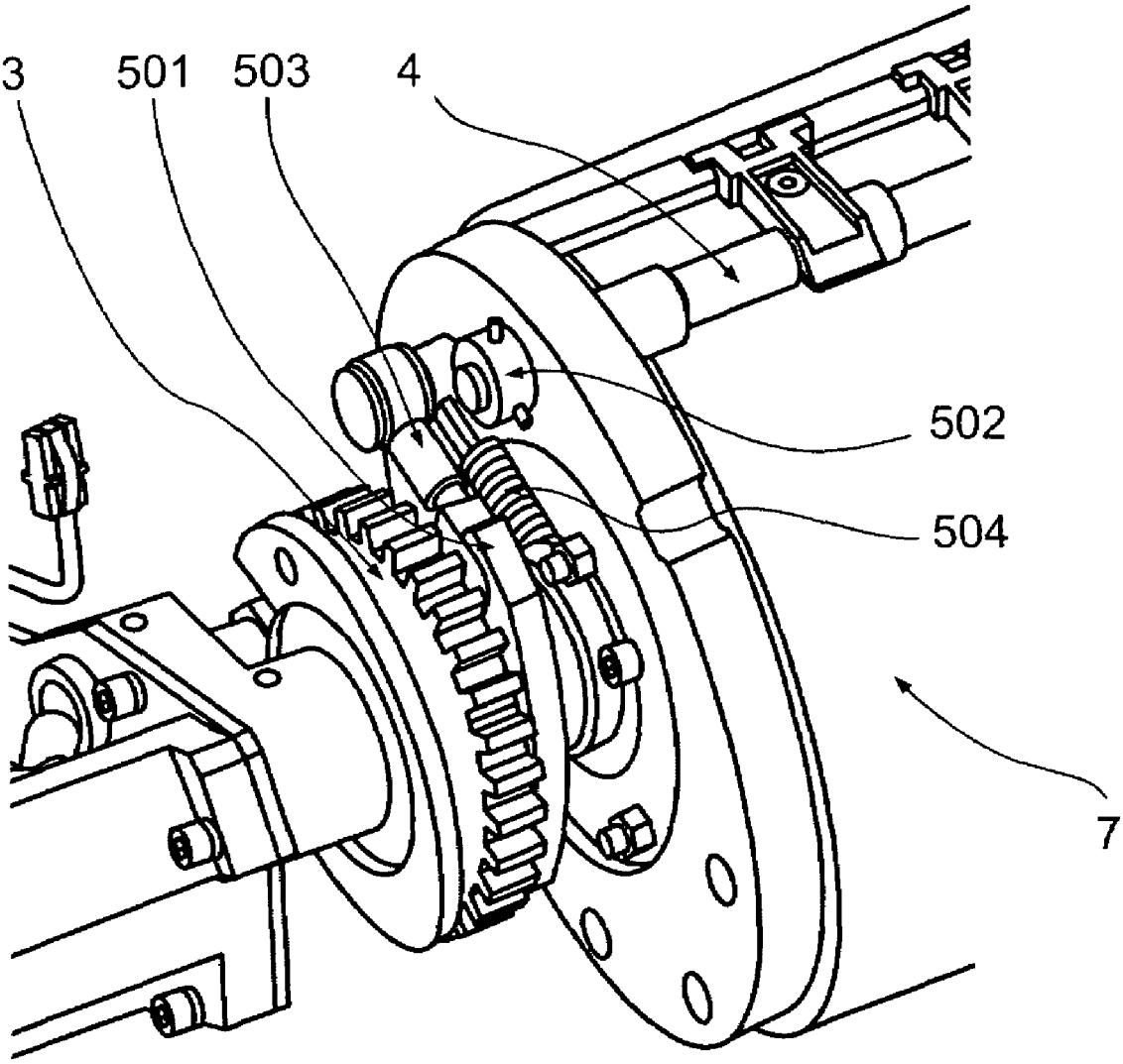
FIG. 4 is a schematic representation of an impression drum having a gripper system with a rotary cam which is connected to a cam follower by a mechanical bridge, according to another embodiment of the present invention.

Reference is now made to FIG. 4, which depicts another embodiment of the present invention. The gripper axis 4, the gear-wheel 3 and the impression drum 7 are similar to those shown in FIG. 2A above. However, instead of rotary cam 9 and cam follower 11, shown in FIG. 2A, the embodiment of FIG. 4 includes a different kind of cam 501 and cam follower 502. In this embodiment the cam 501 and the cam follower 502 are connected using a connecting mechanical bridge 503.

In one embodiment a spring mechanism 504 for returning the cam follower 502 to its former position after it has been moved by the cam 501 is provided.

Figure 5:
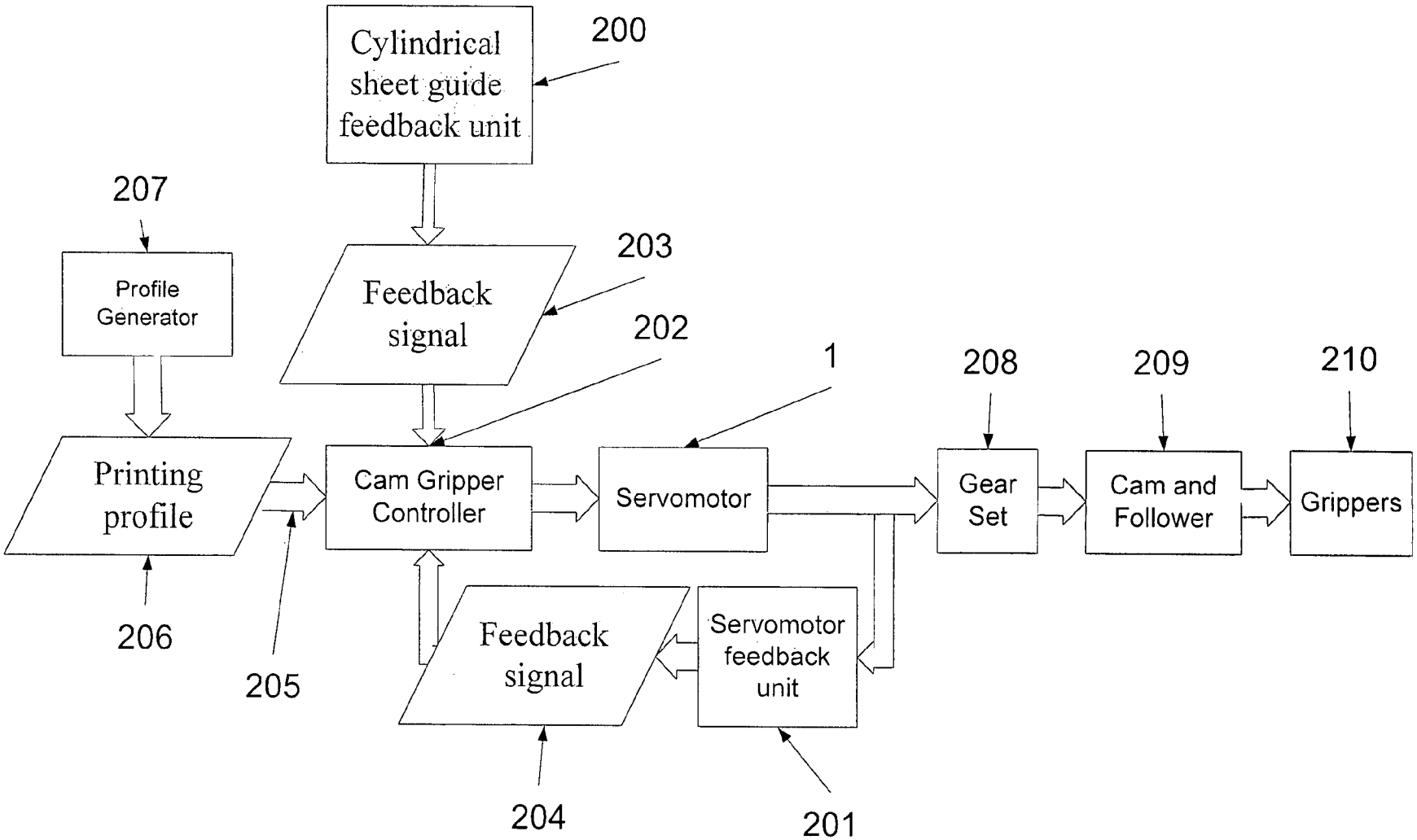
FIG. 5 is a flowchart diagram of the transmission of signals in a gripper system, according to one embodiment of the present invention.

Reference is now made to FIG. 5, which depicts, in flowchart form, a cam-gripper controller 202 which receives feedback signals 203, 204 and a certain printing profile 206 outputs control signals 205 which are transmitted to the servomotor 1, in accordance with an embodiment of the present invention.

In one embodiment in order to maneuver the servomotor 1, the cam-gripper controller 202 receives feedback signals 203, 204 that represent the current rotational angle of the impression drum and the current rotational angle of the cam, respectively. The cam-gripper controller 202 further receives a certain printing profile 206. As described above, a number of printing profiles are stored in a memory which is connected to the cam-gripper controller. In one embodiment a profile generator 207 is used to generate the certain printing profile 206 according to a profile which is chosen from the memory. A servomotor feedback unit 201 coupled to the servomotor 1, outputs a feedback signal 204, which is sent back to the cam-gripper controller 202. The feedback signal 204 represents data regarding the current rotational angle of the axle of the servomotor 1. This data can easily be translated into data that represent the current rotational angle of the cam since, as described above, the cam and the servomotor have engaged gear-wheels.

A feedback unit 200 coupled to the cylindrical sheet guide outputs a feedback signal 203, which is sent back to the cam-gripper controller 202. The feedback signal 203 represents data regarding the current rotational angle of the cylindrical sheet guide.

In one embodiment each of the cylindrical sheet guide feedback unit 200 and the servomotor feedback unit 201 comprises a tachometer, which is configured to measure the RPM of the revolving axle of the servomotor. The readout of the RPM is in the form of an analog signal. In order to use the outputs of the tachometers as references for the control signals, the cam and the impression drum have to be synchronized, optionally as described below.

In one embodiment each of the cylindrical sheet guide feedback unit 200 and the servomotor feedback unit 201 comprises a resolver, which is an electrical transformer used for measuring the rotational angle of the cylindrical sheet guide or the axle of the servomotor. Each resolver comprises a primary winding, which is fixed to the cylindrical sheet guide or to the axle of the servomotor and is excited by a sinusoidal electric current. The sinusoidal electric current causes electromagnetic induction of a current flow in two secondary windings, which are coupled orthogonally to each other on a stationary part of the servomotor (the stator). The relative magnitudes of the two secondary currents are measured and used to determine the angle of the cylindrical sheet guide or the axle or the servomotor relative to the stationary part.

In one embodiment each of the cylindrical sheet guide feedback unit 200 and the servomotor feedback unit 201 comprises an encoder, which is used to encode a signal into a form that is acceptable for transmission. Either analog circuitry for analog encoding or digital circuitry for digital encoding may be used. The encoder, the resolver, and the tachometer are well known in the art and, hence, will not be described here in detail.

In one embodiment of the present invention the cam-gripper controller 202 uses the feedback signals to determine whether the servomotor moves the cam properly according to the received printing profile 206, and, if not, then the cam-gripper controller 202 transmits control signals 205 to the servomotor 1 to make appropriate adjustments. By reducing or increasing the voltage of the control signals 205 which are sent to the servomotor, the cam-gripper controller 202 adjusts the sheet holding space, as described above. The axle of the servomotor may be controlled in any other manner, inter alia, by changing its position, direction, or velocity. The control signals 205 represent changes in the velocity, the position, and direction of the axle of the servomotor 1, which result in adjustment of the gear-wheels 208 that maneuver the rotational angle of the cam that control the cam follower, as shown at 209. As described above, and shown at 210, the cam follower controls the cylindrical sheet guide's grippers.

Figure 6:
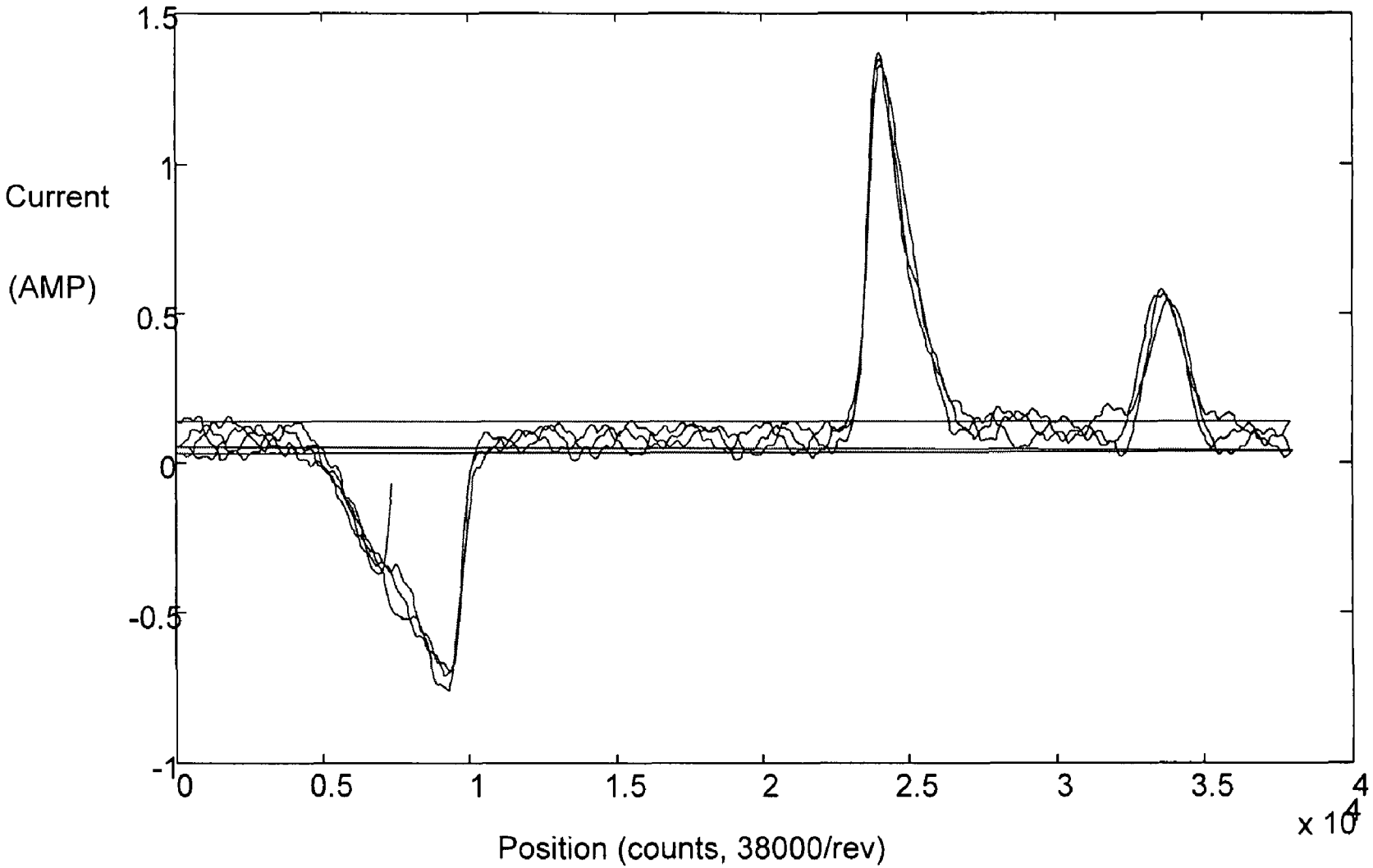
FIG. 6 is a graph that depicts a signal which is generated by a feedback unit during one complete rotation of the cam, in accordance with the present invention.

Reference is now made to FIG. 6, which is a graph that depicts a signal, which is generated by the cam feedback during a one complete rotation of the rotary cam, in accordance with the present invention. The Y-axis denotes the current in Ampere units (amp) and the X-axis denotes a cycle that represents one complete rotation of the rotary cam. Each point along the X-axis corresponds to a different point along the circumference of the cam.

As described above, the control signals, which are used to maneuver the cam during the printing process, may be generated according to the current rotational position of the cylindrical sheet guide and the cam. However, in order to utilize the control signals to affect pivoting of the rotary cam, the rotational positions of the cylindrical sheet guide and the cam have to be synchronized before they are analyzed.

The feedback signal represents the rotational force (torque) of the axle of the servomotor relative to different rotational positions of the cam. Since the cam's profile is nonuniform, the torque varies therealong. As commonly known, torque is a function of the force applied to a lever, multiplied by its distance from the point around which the lever rotates (fulcrum). This is true on condition that the force is in a direction at right angles to the lever. Since the gear-wheel of the cam and gear-wheel of the servomotor axle are engaged, the gear-wheel of the cam applies an opposing force to the gear-wheel of the servomotor axle. The applied force is a derivative of the radius of the rotary cam which is engaged with the cam follower. The longer the radius, the greater will be the applied force and, thus, the lower will be the torque of the axle of the servomotor. Accordingly, the amount of the torque at any point along the graph depends on the radius of the cam at a particular rotational position.

In one embodiment of the present invention, a sequence of torque levels of the axle of the servomotor during one rotation of the cam is recorded and stored in the memory of the cam-gripper controller as a reference pattern for synchronization. The recording of the reference pattern is a one-time event, which occurs during the calibration of the printing press. The recorded sequence of the torque levels is correlated with the cam's profile and a known initial rotational position is recorded. The sequence of torque levels is recorded when the rotational position of the cylindrical sheet guide is stable.

Since the torque levels of the reference pattern are correlated with known rotational positions of the cam, the deviation between the reference pattern and the current feedback signals may be used to identify an angular deviation between the current rotational position of the cam and its known initial rotational position. Based upon the identified deviation, the gripper system may be synchronized by rotating the cam to the known initial rotational position.

Figure 7:
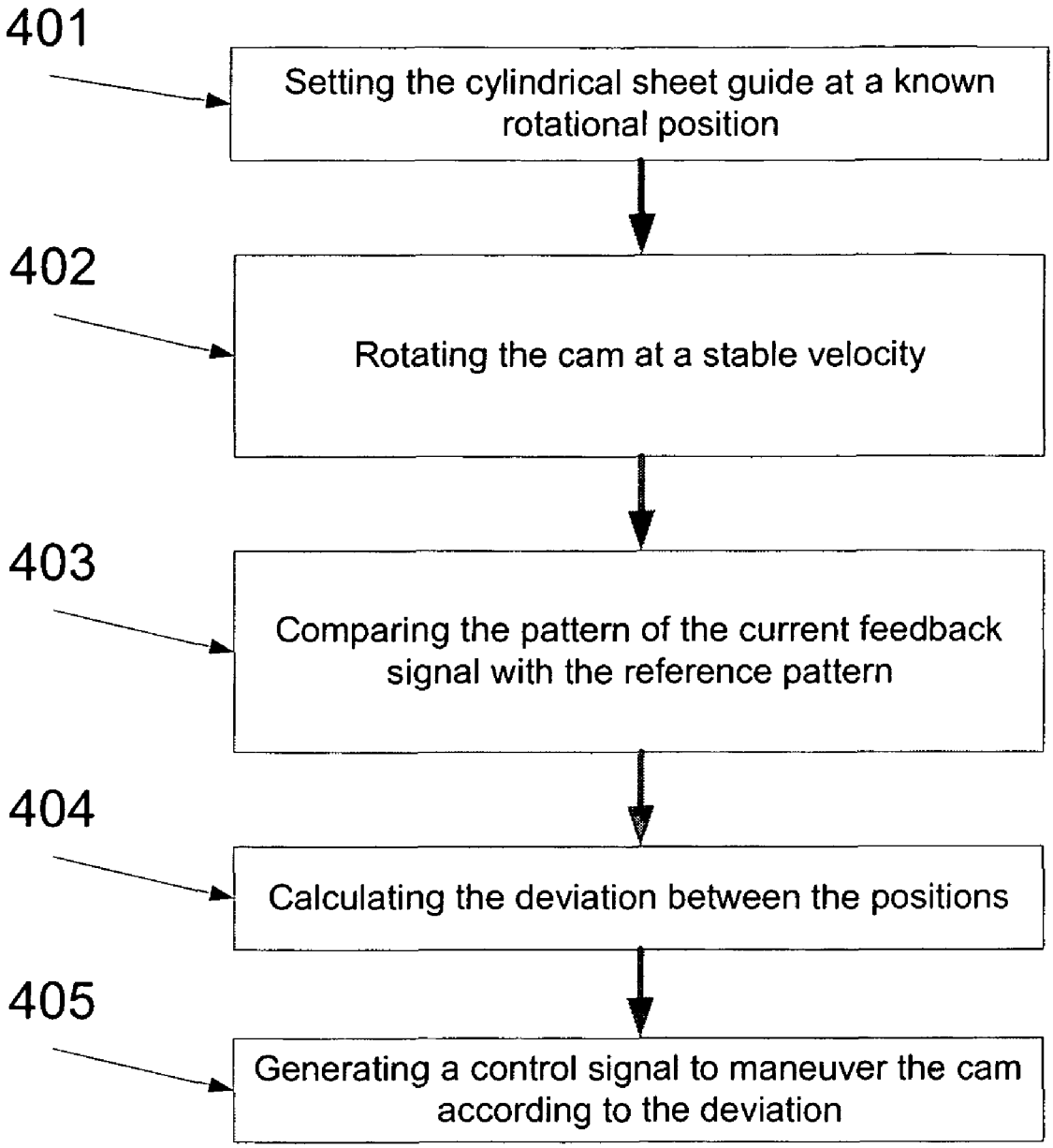
FIG. 7 is a simplified flowchart diagram of a method for synchronizing a rotary cam, according to an embodiment of the present invention.

Reference is now made to FIG. 7, which is a flowchart of an exemplary method for synchronizing a cam according to an embodiment of the present invention. During the first step, 401, the cylindrical sheet guide is set at a known rotational position. Since the rotational position of the cam relative to the rotational position of the cylindrical sheet guide is important, setting the cylindrical sheet guide at a known rotational position facilitates the synchronization between the two annular assemblies. During the subsequent step, as shown at 402, the cam rotates a complete revolution at a velocity of, optionally approximately 10 RPM. During revolution of the cam, the feedback unit generates a feedback signal that represents the torque of the axle of the servomotor during the revolution. In one embodiment the current feedback signals, which are produced during one complete rotation of the cam, are recorded. The peak of the feedback signals that represent the torque is identified in order to improve the accuracy of the deviation calculation process. A fine-tuning of the positioning of the peak is done by remeasuring the torque along the rotary cam circumference at 5 degrees to either side of the identified peak and identifying the exact rotational angle of the rotary cam that has the highest torque. The rescanning is done at a low velocity.

As shown at 403, after the revolution has been completed, the feedback signals are compared with the reference pattern. In one embodiment the recorded current feedback signals are smoothed and filtered in order to facilitate matching of the patterns. This may be done by comparing the recorded current feedback signals and the reference pattern, as described above. By comparing the patterns, a pattern deviation is identified. The deviation represents the angular deviation between the current rotational angle of the rotary cam and the known initial rotational position. Calculating pattern deviation is well known in the art and, hence, will not be described here in detail.

Based upon the pattern deviation, the angular deviation between the current rotational position and the known rotational position is calculated, as shown at step 404. During the subsequent step, as shown at 405, a control signal is sent to the servomotor in order to adjust the angle of rotation of the cam according to the calculated deviation.

Figure 8B:
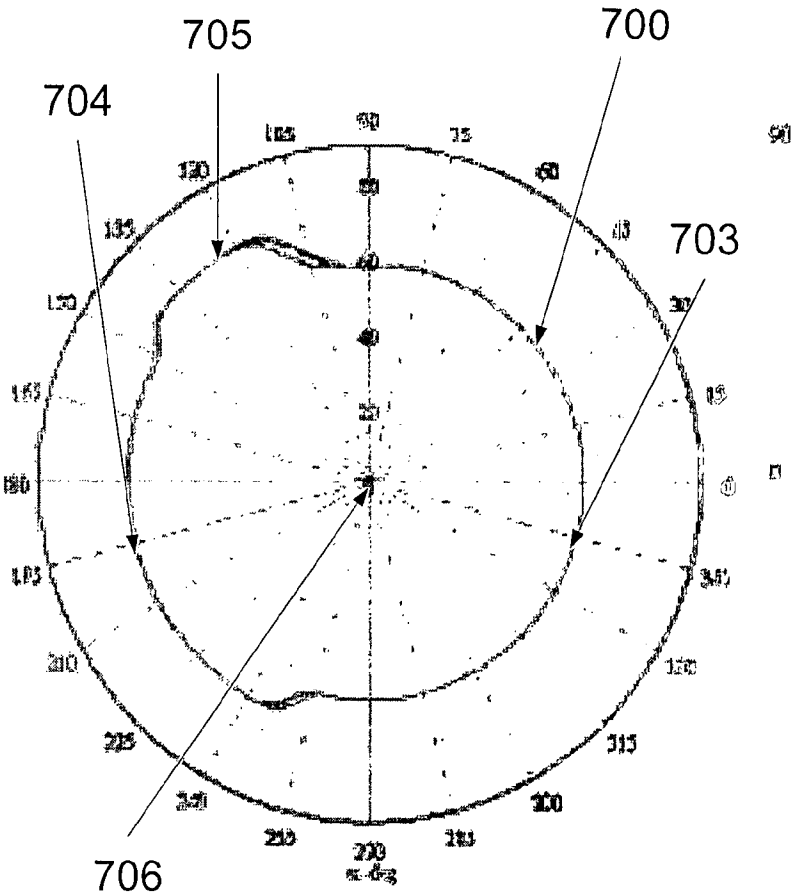
FIG. 8B is an abstract graphical representation of a second rotary cam, according to an embodiment of the present invention.
Figure 8A:
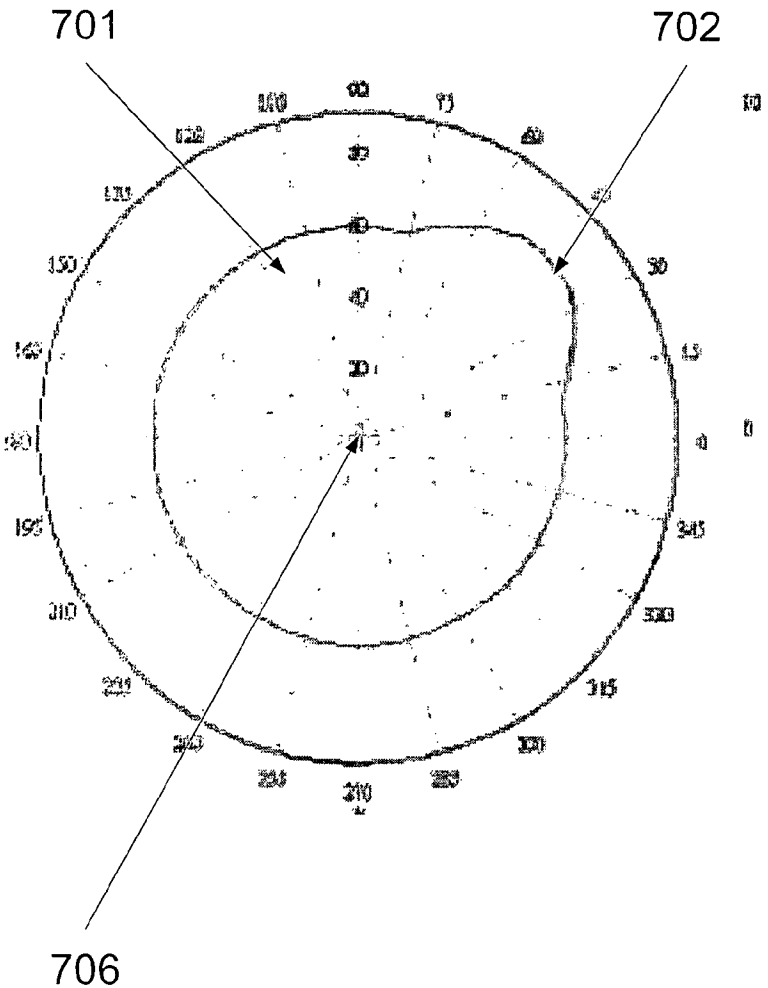
FIG. 8A is an abstract graphical representation of a first rotary cam, according to an embodiment of the present invention.

Reference is now made to FIGS. 8A and 8B, which are abstract graphical representations of a first rotary cam 701 and a second rotary cam 700, respectively, according to embodiments of the present invention. As depicted above (FIG. 2A), the gripper system, according to some embodiments of the present invention, comprises a rotary cam having an irregularly-shaped circumference. The rotary cam is used in order to transfer rotary motion to linear motion of a cam follower, which is connected to one or more grippers. The circumference of the cam is a profile that represents a mechanical encoding of that determines the grippers' elevation during rotation of a cylindrical sheet guide. As further described above, the cam is actuated by a servomotor, which is configured to maneuver the cam according to a number of profiles. The motion of the cam is correlated with the motion of a cylindrical sheet guide such that the grippers are opened and closed in accordance with the profile of the cam. By actuating the cam according to an adjusted profile, the reliability of the printing process increases. Such an embodiment improves the reliability of printing presses having higher printing velocities.

However, as described above, the elevation of the grippers is a derivative of the cam profile. Accordingly, in order to improve the performance of the gripper system, the cam and the different profile of the servomotor have to be correlated.

FIG. 8A depicts a cam 701 having a certain profile, which is designed to be set at variable velocities relative to the velocity of the cylindrical sheet guide. By changing the velocity of the rotary cam 701, the rotational angle at which the cam follower and the protruding area 702 of the rotary cam 701 meet is changed. Accordingly, by changing the velocity of the rotary cam 701, the servomotor can implement a certain printing profile.

FIG. 8B depicts a cam 700 having a certain profile, which is designed to be set at a constant rotational position during most of the printing process. The rotation of the cylindrical sheet guide, which may be an impression drum, causes a change in the elevation of the cam follower and the grippers according to the profile of the cam. For example, when the cam follower touches the surface of the cam, as shown at 703, the gripper is closed; when it touches the surface of the cam, as shown at 704, the gripper is partially open; and when it touches the surface of the cam, as shown at 705, the gripper is fully open. Such a model allows predefining the exact elevation of the grippers relative to any rotational position of the cylindrical sheet guide. Accordingly, by changing the rotational position of the rotary cam 700, the servomotor can implement different printing profiles during the printing process. It should be noted that the positioning of each gripper is limited, depending on the cam's profile. As shown in FIG. 8B, the highest and lowest positions of the grippers relative to the cylindrical sheet guide are at points 705 and 703, respectively.

In order to allow the opening of the grippers at more than one rotational angle, the servomotor may direct the rotary cam 700, as described above, to different rotational positions in relation to the rotation of the cylindrical sheet guide. This allows loading of a sheet onto an impression drum from a duplex tray, a perfector mechanism or a sheet loader.

As described above, during some printing processes, a sheet may remain gripped on the cylindrical sheet guide for more than one rotation thereof. For example, in some printing processes, only one color may be applied on the gripped sheet per rotation of the cylindrical sheet guide. Thus, in such printing processes, the grippers have to remain closed for a number of consecutive rotations until the image of the printing job has been fully printed on the sheet. In order to allow printing according to such a printing process, the servomotor may rotate the rotary cam at the same velocity as the cylindrical sheet guide during consecutive rotations in which the grippers have to remain closed. The rotary cam is rotated in order to keep the contact point between the rotary cam and the cam follower on an area 703 of the rotary cam profile, which is relativity close to the center of the cam 706.

By using such a cam, the servomotor may rotate the cam to control the elevation of the grippers during the printing process in a more accurate manner. By using such adjusted cams, the servomotor is able to maneuver the grippers to different elevations during each revolution of the cam. The cam may have a graded structure, which is adjusted to reduce the jarring which occurs during revolution of the cam.

Figure 9:
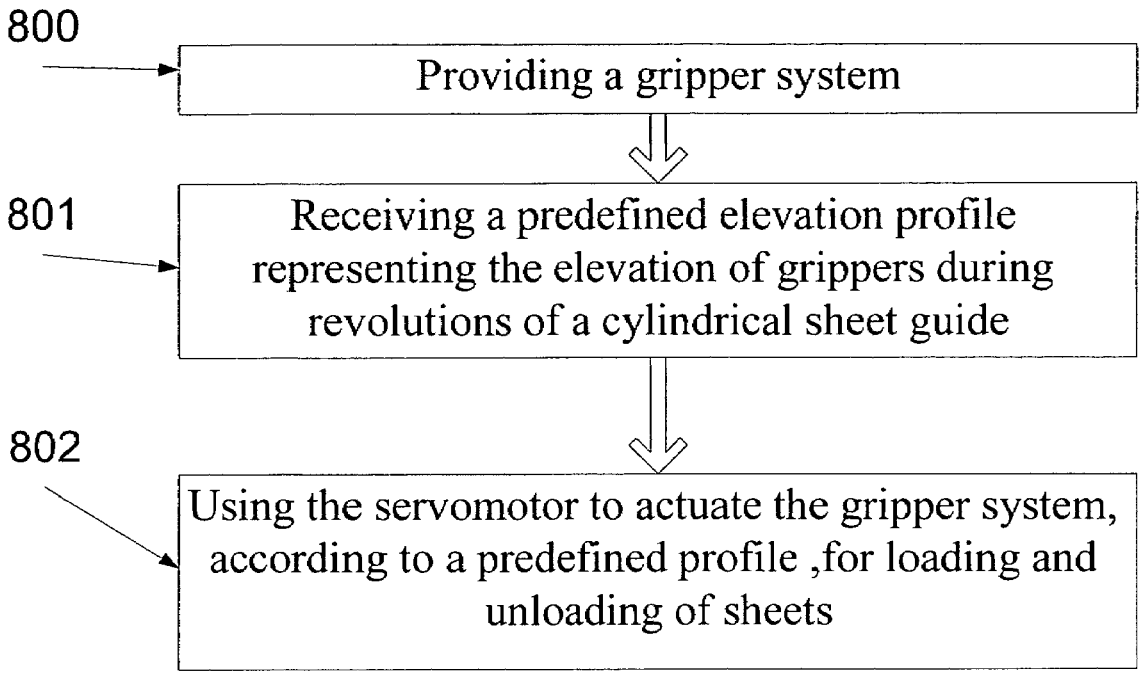
FIG. 9 is a simplified flowchart diagram of a method for controlling loading and unloading of sheets from a cylindrical sheet guide, according to an embodiment of the present invention.

Reference is now made to FIG. 9, which is a flowchart that illustrates a method for controlling loading and unloading of sheets from a cylindrical sheet guide, according to an embodiment of the present invention. First, as shown at 800, there is provided a servomotor and a gripper system, which is configured for controlling the elevation of grippers on a cylindrical sheet guide, as described above. In one embodiment the gripper system comprises a set of engaged gear-wheels, which are connected to a rotary cam. The rotary cam is positioned in the vicinity of a cam follower, which is associated with a gripper. Subsequently, as shown at 801 a predefined elevation profile representing the elevation of the grippers during one or more revolutions of the cylindrical sheet guide is received. In one embodiment, as described above, the predefined elevation profile is chosen by a cam-gripper controller from a profile repository that comprises a number of predefined elevation profiles. In one embodiment each predefined elevation profile corresponds to a particular sheet having a particular thickness. Then, The rotational positions of the cam and the cylindrical sheet guide are identified and synchronized. Thereafter, a printing process is initiated. During the printing process, as shown at 802, the servomotor is used to actuate the gripper system according to the predefined profile for loading and unloading sheets from the cylindrical sheet guide.

Figure 10:
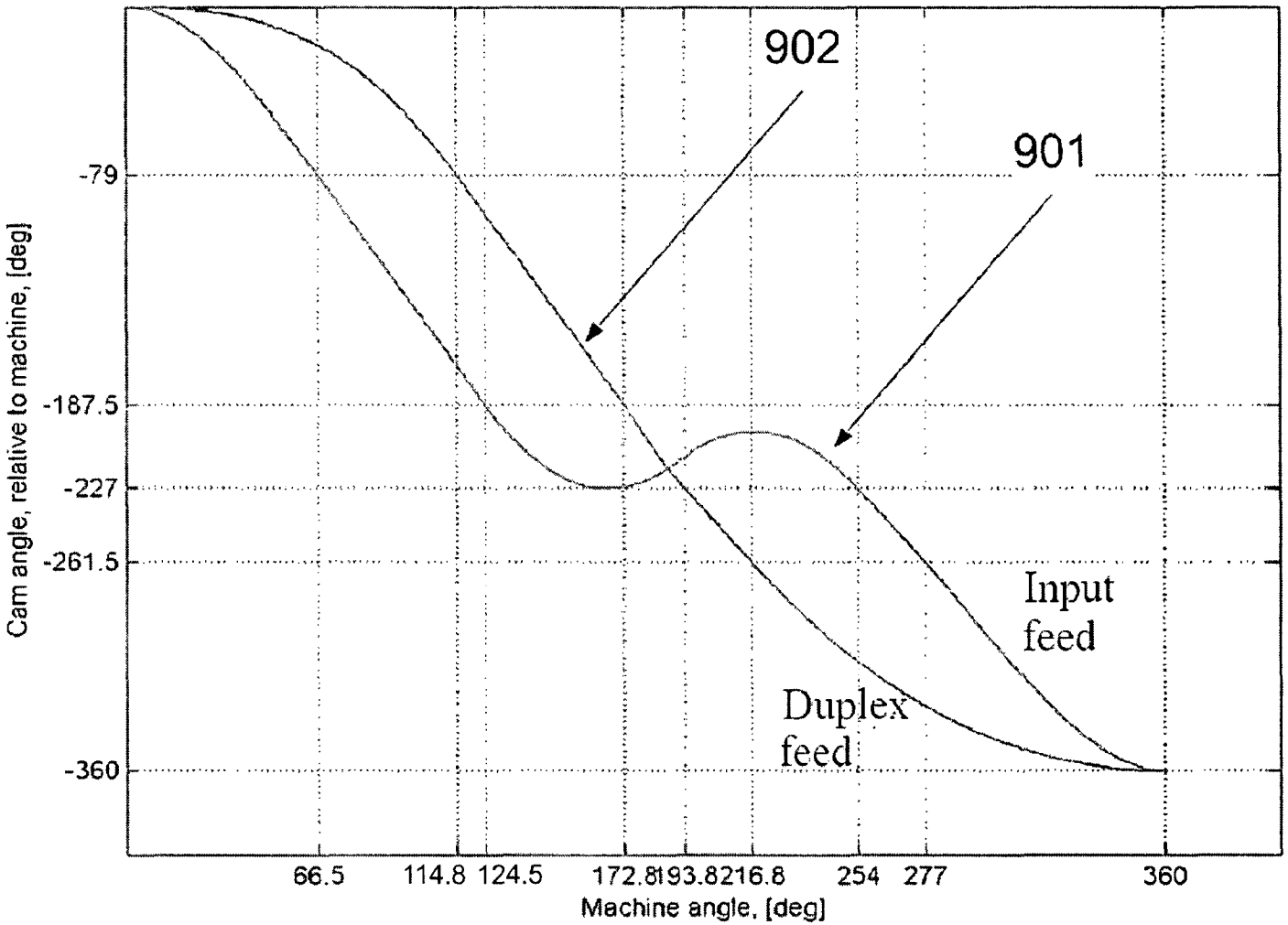
FIG. 10 is a graph that depicts two exemplary profiles according which the cam is rotated by the servomotor, in accordance with the present invention.

Reference is now made to FIG. 10, which is a graph that depicts two predefined profiles, which are implemented using the servomotor, in accordance with the present invention. As described above the servomotor can actuate the gripper system according to different printing profiles, during the printing process. FIG. 10 depicts two exemplary profiles according to which the cam is rotated by the servomotor. The Y-axis denotes the cam angle relative to the impression drum (degrees) and the X-axis denotes the angle of the impression drum (degrees). One of the curves in the graph 901 depicts the cam angle in relation to the impression drum angle when an "Input feed" profile is implemented using the servomotor. The other curve in the graph 902 depicts the cam angle in relation to the impression drum angle when a "Duplex feed" profile is implemented using the servomotor. As seen in FIG. 10, the implementation of different profiles using the same cam, allows the performance of different elevation schemes. Thus, profiles which are better adjusted to different printing profiles may be used at the appropriate time during the printing process. Such an implementation can clearly reduce the likelihood of jams and other malfunctions. Moreover, as the elevation of the sheet holding space is changed according to an adjusted profile, the registration of the printing press is improved. Another advantage of this design is that the adjusted paper path reduces bending on the printed sheets and guarantees a non-smear paper run during the printing process.

It is expected that during the life of this patent many relevant devices and systems will be developed and the scope of the terms herein, particularly of the terms controller, circuitry, printing press, impression drum, and image sensor are intended to include all such new technologies a priori.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents, and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

The invention claimed is:

1. A gripper system for controlling loading and unloading of sheets on a cylindrical sheet guide, said gripper system comprising:

at least one gripper positioned at an outer edge of said cylindrical sheet guide, said at least one gripper coupled to at least one cam follower and configured for holding the sheets on said cylindrical sheet guide;

a cam configured for affecting elevation of said at least one gripper relative to said cylindrical sheet guide by moving said at least one cam follower;

a servomechanism adapted for actuating said cam;

a sheet thickness identifier configured to detect a thickness of the sheets; and a cam-gripper controller adapted for controlling said servomechanism according to a current printing profile and adjusting a height between said at least one gripper and said cylindrical sheet guide during a printing process, wherein said current printing profile corresponds to the thickness of the sheets.

2. The gripper system of claim 1, wherein said cam is one member of the group consisting of: a rotary cam and a linear cam.

3. The gripper system of claim 1, further comprising a first feedback unit for indicating a current rotational angle of said cylindrical sheet guide and a second feedback unit for indicating a current rotational angle of an axle of said servomechanism, said cam-gripper controller adapted for controlling said servomechanism in response to signals transmitted thereto from said first and second feedback units to correlate a rotational position of said cam and a rotational position of said cylindrical sheet guide.

4. The gripper system of claim 3, wherein each of said first and second feedback units comprises at least one member of the group consisting of: an encoder, a resolver and a tachometer.

5. The gripper system of claim 1, wherein said cam-gripper controller is adapted to change a velocity and/or direction of rotation of an axle of said servomechanism to change a rotational angle of said cam in relation to a rotational angle of said cylindrical sheet guide.

6. The gripper system of claim 1, wherein said cam-gripper controller is coupled to a printing profile repository, said printing profile repository comprising a plurality of predefined printing profiles, wherein each of said plurality of predefined printing profiles corresponds to a particular sheet having a particular thickness.

7. The gripper system of claim 6, wherein said cam-gripper controller is adapted for choosing a current printing profile from said plurality of predefined printing profiles.

8. The gripper system of claim 6, wherein a mechanical profile of said cam is configured relative to said plurality of predefined printing profiles.

9. The gripper system of claim 1, wherein said cylindrical sheet guide is one of the following group: an impression drum, a storage drum, a delivery drum and a perfecting cylinder.

10. The gripper system of claim 1, wherein each of said at least one cam follower is coupled to said cam by a movable mechanical bridge.

11. The gripper system of claim 1, wherein said servomechanism comprises a servomotor or a servo-pneumatic actuator.

12. The gripper system of claim 1, wherein said servomechanism directs said cam to different rotational positions in relation to rotation of said cylindrical sheet guide to allow opening of said at least one gripper at more than one rotational angle.

13. The gripper system of claim 1, wherein said servomechanism rotates said cam at a same velocity as said cylindrical sheet guide to keep said at least one gripper closed.

* * * * *